US005252947A

United States Patent [19]

Marciano

[11] Patent Number: 5,252,947

[45] Date of Patent: Oct. 12, 1993

[54] HOME SECURITY DEVICE SIMULATING A TELEVISION RECEIVER

[76] Inventor: Michael Marciano, 2728 Beatrice La., Bellmore, N.Y. 11710

[21] Appl. No.: 833,080

[22] Filed: Feb. 10, 1992

[51] Int. Cl.[5] ..... G08B 29/00; G08B 25/08

[52] U.S. Cl. ..... 340/515; 340/692; 340/693

[58] Field of Search ..... 340/515, 541, 545, 692, 340/691, 693

[56] References Cited

U.S. PATENT DOCUMENTS 4,212,007 7/1980 Reyes et al. ..... 340/692

4,571,583 2/1986 Giordano ..... 340/692

4,970,489 11/1990 Jenkins et al. ..... 340/546

*Primary Examiner*—Donnie L. Crosland

*Attorney, Agent, or Firm*—Michael I. Kroll

[57] ABSTRACT

A home security device is provided for simulating a television receiver which consists of a housing having an electrical circuit therein, a mechanism for electrically connecting the electrical circuit in the housing to a power source and a mechanism electrically connected to the electrical circuit in the housing for simulating the picture of the television receiver, so that a potential burglar will think someone is home watching the television receiver and not break into the home.

7 Claims, 2 Drawing Sheets

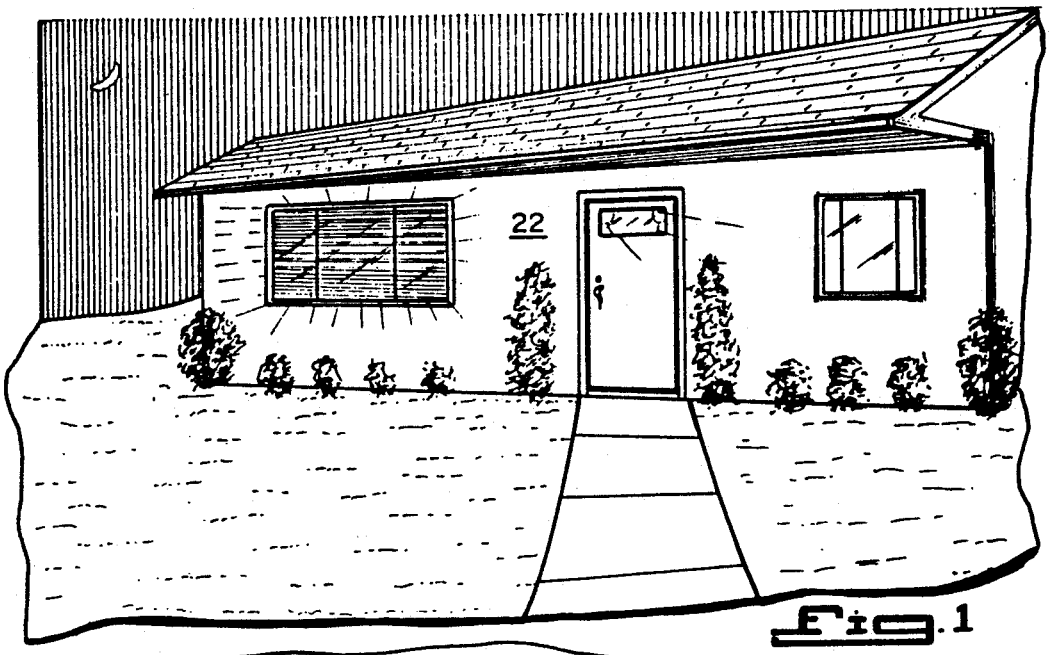
Fig. 1
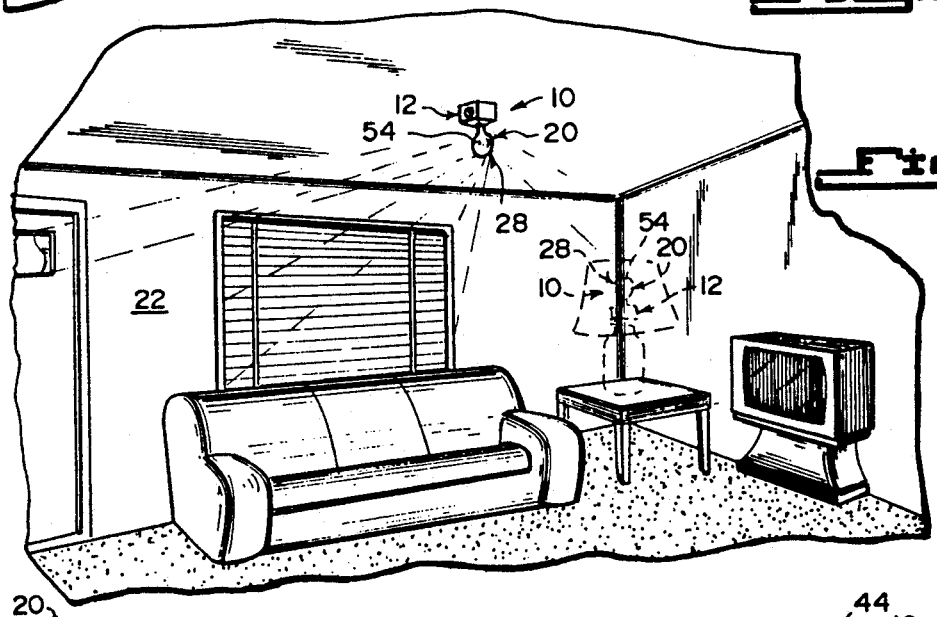
Fig. 2
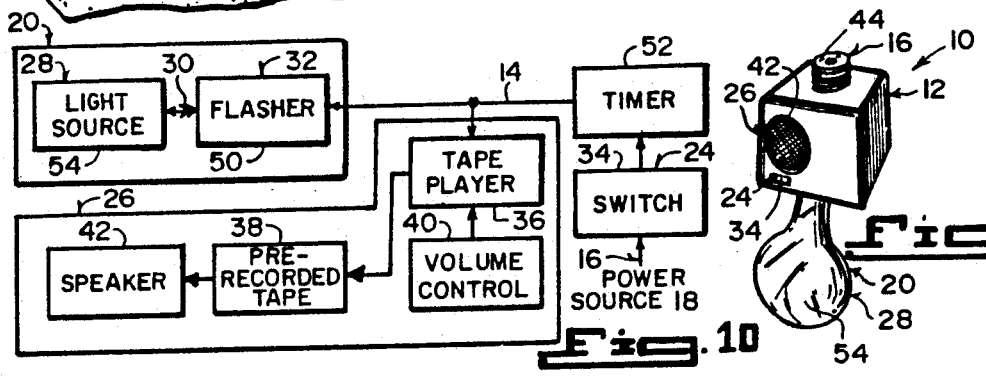
Fig. 10
Fig. 3

Fig. 4
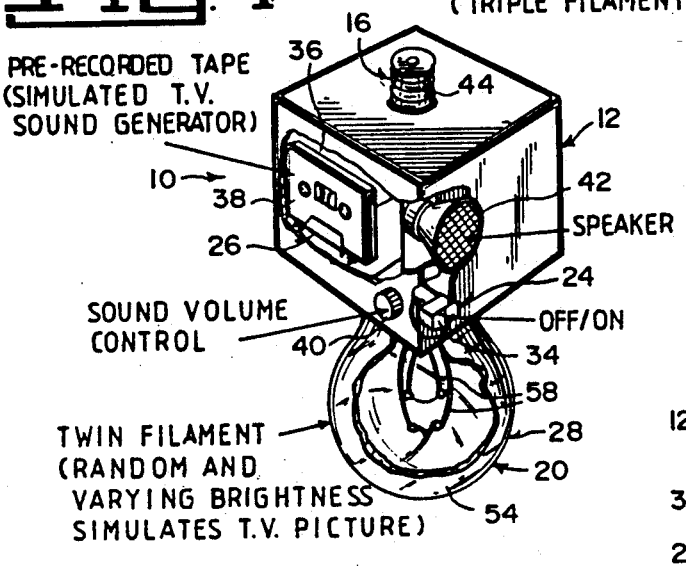
Fig. 4A
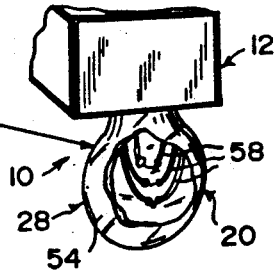
Fig. 5
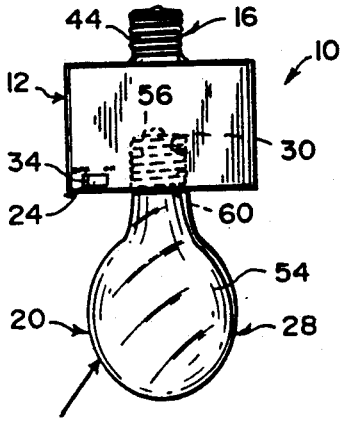
(BLUE COLORED-TWIN FILAMENT-VARYING BRIGHTNESS-SIMULATES T.V. PICTURE ONLY-NO SOUND)
Fig. 6
(FLUORESCENT SIMULATION OF T.V.)
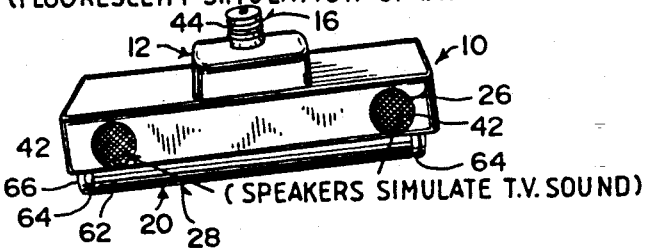
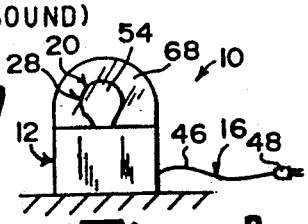
Fig. 8
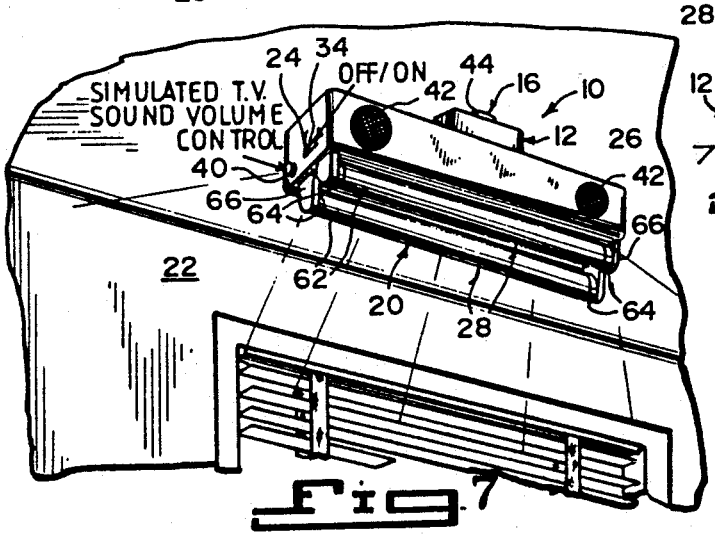
Fig. 7
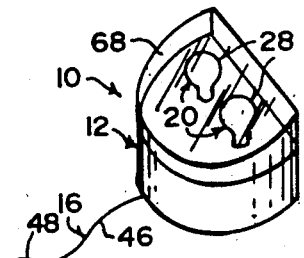
Fig. 9

HOME SECURITY DEVICE SIMULATING A TELEVISION RECEIVER

DESCRIPTION OF THE PRIOR ART

Numerous burglary deterrent systems have been provided in prior art that are adapted to prevent the unauthorized entry of burglars into a building by utilizing audio and visual activation mechanisms. While these units may be suitable for the particular purpose to which they address, they would not be as suitable for the purposes of the present invention as heretofore described.

SUMMARY OF THE INVENTION

A primary object of the present invention is to provide a home security device simulating a television receiver that will overcome the shortcomings of the prior art devices.

Another object is to provide a home security device simulating a television receiver in which the activation of a multi-color pulsating light will simulate the picture of the television receiver turned on in the home to fool a burglar to thinking that someone is in the home watching the television receiver.

An additional object is to provide a home security device simulating a television receiver in which the activation of a pre-recorded tape in combination with the multi-color pulsating light will simulate the sound and the picture of the television receiver turned on in the home to fool a burglar.

A further object is to provide a home security device simulating a television receiver that is simple and easy to use.

A still further object is to provide a home security device simulating a television receiver that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

FIG. 1 is a front perspective view of a house with the instant invention employed therein.

FIG. 2 is a perspective view of the interior of the house showing a first embodiment of the instant invention installed within a ceiling socket in a room.

FIG. 3 is a perspective view of the first embodiment per se used in FIG. 2.

FIG. 4 is a perspective view with parts broken away of the first embodiment showing some of the electrical components in greater detail.

FIG. 4A is a perspective view with parts broken away of a portion of a second embodiment showing a triple filament incandescent light bulb being used.

FIG. 5 is an elevational view of a third embodiment which only simulates the TV picture and not the sound.

FIG. 6 is a perspective view of a fourth embodiment utilizing fluorescent light bulbs instead of incandescent bulbs to simulate the TV picture.

FIG. 7 is a perspective view of the fourth embodiment installed within a ceiling socket in a room.

FIG. 8 is an elevational view of a fifth embodiment of a plug in type utilizing one incandescent light bulb.

FIG. 9 is a perspective view of a sixth embodiment being a plug in type utilizing two incandescent light bulbs.

FIG. 10 is a block diagram showing the various electrical components used.

DETAILED DESCRIPTION OF THE PREFERRED EMBODIMENTS

Turning now descriptively to the drawings, in which similar reference characters denote similar elements throughout the several views, the Figures illustrate a home security device 10 for simulating a television receiver which consists of a housing 12, having an electrical circuit 14 therein. A mechanism 16 is for electrically connecting the electrical circuit 14 in the housing 12 to a power source 18. A mechanism 20 is electrically connected to the electrical circuit 14 in the housing 12 for simulating the picture of the television receiver, so that a potential burglar will think someone is home watching the television receiver and not break into the home 22.

The home security device 10 further includes a mechanism 24 electrically connected between the electrical circuit 14 in the housing and the power source 18 for turning the picture simulating mechanism 20 on and off. A mechanism 26 is electrically connected to the electrical circuit 14 in the housing 12 for simulating the sound of the television receiver, whereby the on and off turning mechanism 24 will also turn the sound simulating mechanism 26 on and off.

The picture simulating mechanism 20 includes a light source 28 for producing a blue color therefrom. A mechanism 30 is for electrically connecting the light source 28 to the electrical circuit 14 in the housing 12. A mechanism 32 is electrically connected to the electrical circuit 14 in the housing 12 for varying the brightness of the light source 28.

The on and off turning mechanism 24 is a switch 34. The sound simulating means 26 includes a tape player 36 built into the housing 12. A pre-recorded tape 38 is played within the tape player 36. A volume control 40 on the housing 12 is electrically connected to the tape player 36. At least one speaker 42 built into the housing 12 is electrically connected to the tape player 36.

The housing electrically connecting mechanism 16, as best shown in FIGS. 3, 4, 5 and 6, includes a threaded base member 44 on the housing 12 electrically connected to the electrical circuit 14 in the housing 12. The threaded base member 44 can be screwed into a threaded socket in an electrical receptacle in the home which is electrically connected to the power source 18.

The housing electrically connecting means 16, as shown in FIG. 8 and 9, includes a power cord 46 extending from the housing 12 electrically connected to the electrical circuit 14 in the housing 12. A plug 48 is electrically connected to a distal end of the power cord 46, so that the plug 48 can be inserted into a wall outlet in the home 22, which is electrically connected to the power source 18.

The light source varying brightness mechanism 32 is a flasher 50, built into the housing 12. A time 52 is built into the housing 12 and is electrically connected to the electrical circuit 14 between the switch 34, the flasher 50 and the tape player 36. The timer 52 can operate the flasher 50 and the tape player 36 during predetermined time intervals.

The light source 28 can be an incandescent bulb 54, having a threaded base 56 and multiple filaments 58 therein. The light source electrically connecting mechanism 30 includes a threaded socket 60 in the housing 12, which is electrically connected to the electrical circuit 14, so that the threaded base 56 of the incandescent bulb 54 can be screwed into the threaded socket 60 in the housing 12.

The filaments 58 can be blue in color and said bulb 54 clear. The filaments 58 can be clear and the bulb 54 blue in color. In either case, the incandescent bulb 28 will produce a blue color for simulating the picture of the television receiver.

The light source 28, as shown in FIGS. 6 and 7, can be a pair of blue colored fluorescent bulbs 62, with each having base ends 64 thereon. The light source electrically connecting mechanism 30 includes a fluorescent fixture 66 built onto the housing 12, which is electrically connected to the electrical circuit 14, so that the base end 64 of the fluorescent bulbs 62 can be connected into the fluorescent fixture 66 on the housing 12.

The home security device 10, as shown in FIGS. 8 and 9, can further include a protective dome 68, which fits over the light source 28. The light source 28 is clear and the protective dome 68 is blue in color.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A home security electronic device simulating a person at home watching a simulated television receiver, which comprises:

a) a housing having an electrical circuit therein;

b) means for electrically connecting said electrical circuit in said housing to a power source; and c) means electrically connected to said electrical circuit in said housing for projecting an illusion of a television receiver, said illusion is random, simulates action on said simulated television receiver, changes scenes on said simulated television and changes channels and programs, so that a potential burglar will think someone is home watching said television receiver and will therefore prevent a break in by acting as a deterrent not an alarm and is in effect operative before a break in is tried said housing electrically connected means includes a threaded base member on said housing electrically connected to said electrical circuit in said housing, so that said threaded base member can be screwed into a threaded socket in electrical receptacle in the home which is electrically connected to the power source, said sound simulating means includes a tape player built into said housing, a pre-recorded tape played within said tape player, a volume control on said housing electrically connected to said tape player, at least one speaker built into said housing electrically connected to said tape player, said on and off turning means is a switch, said picture simulating means includes a light source for producing a blue color therefrom, means for electrically connecting said light source to said electrical circuit in said housing, means electrically connected to said electrical circuit in said housing for varying the brightness of said light source;

d. means electrically connected to said electrical circuit in said housing for simulating the sound of the television receiver, whereby said on and off turning means will also turn said sound simulating means on and off; and e. means electrically connected between said electrical circuit in said housing and the power source for turning picture simulating means on and off.

2. A home security device simulating a television receiver as recited in claim 1, further including a protective dome which fits over said light source.

3. A home security device simulating a television receiver as recited in claim 2, wherein said light source is clear and said protective dome is blue in color.

4. A home security electronic device simulating a person at home watching a simulated television receiver, which comprises:

a) a housing having an electrical circuit therein;

b) means for electrically connecting said electrical circuit in said housing to a power source;

c) means electrically connected to said electrical circuit in said housing for projecting an illusion of a television receiver, said illusion is random, simulates action on said simulated television receiver, changes scenes on said simulated television and changes channels and programs, so that a potential burglar will think someone is home watching said television receiver and will therefore prevent a break in by acting as a deterrent not an alarm and is in effect operative before a break in is tried said light source electrically connecting means includes a threaded socket in said housing which is electrically connected to said electrical circuit, so that said threaded base of said incandescent bulb can be screwed into said threaded socket in said housing, said light source is an incandescent bulb having threaded base and multiple filaments therein, a timer built into said housing and electrically connected to said electrical circuit between said switch, said flasher and said tape player, so that said time can operate said flasher and said tape player during predetermined time intervals, said light source varying brightness means is a flasher built into said housing, said sound simulating means includes a tape player built into said housing, a pre-recorded tape played within said tape player, a volume control on said housing electrically connected to said tape player, at least one speaker built into said housing electrically connected to said tape player, said on and off turning means is a switch, said picture simulating means includes a light source for producing a blue color therefrom, means for electrically connecting said light source to said electrical circuit in said housing, means electrically connected to said electrical circuit in said housing for varying the brightness of said light source;

d) means electrically connected to said electrical circuit in said housing for simulating the sound of the television receiver, whereby said on and off turning means will also turn said sound simulating means on and off; and e) means electrically connected between said electrical circuit in said housing and the power source for turning picture simulating means on and off.

5. A home security electronic device simulating a person at home watching a simulated television receiver, which comprises:

a) a housing having an electrical circuit therein;

b) means for electrically connecting said electrical circuit in said housing to a power source; and c) means electrically connected to said electrical circuit in said housing for projecting an illusion of a television receiver, said illusion is random, simulates action on said simulated television receiver, changes scenes on said simulated television and changes channels and programs, so that a potential burglar will think someone is home watching said television receiver and will therefore prevent a break in by acting as a deterrent not an alarm and is in effect operative before a break in is tried said filaments are blue in color and said bulb is clear, said light source electrically connecting means includes a threaded socket in said housing which is electrically connected to said electrical circuit, so that said threaded base of said incandescent bulb can be screwed into said threaded socket in said housing, said light source is an incandescent bulb having threaded base and multiple filaments therein, a timer built into said housing and electrically connected to said electrical circuit between said switch, said flasher and said tape player, so that said time can operate said flasher and said tape player during predetermined time intervals, said light source varying brightness means is a flasher built into said housing, said sound simulating means includes a tape player built into said housing, a pre-recorded tape played within said tape player, a volume control on said housing electrically connected to said tape player, at least one speaker built into said housing electrically connected to said tape player, said on and off turning means is a switch, said picture simulating means includes a light source for producing a blue color therefrom, means for electrically connecting said light source to said electrical circuit in said housing, means electrically connected to said electrical circuit in said housing for varying the brightness of said light source;

d. means electrically connected to said electrical circuit in said housing for simulating the sound of the television receiver, whereby said on and off turning means will also turn said sound simulating means on and off; and e. means electrically connected between said electrical circuit in said housing and the power source for turning picture simulating means on and off.

6. A home security electronic device simulating a person at home watching a simulated television receiver, which comprises:

a) a housing having an electrical circuit therein;

b) means for electrically connecting said electrical circuit in said housing to a power source; and c) means electrically connected to said electrical circuit in said housing for projecting an illusion of a television receiver, said illusion is random, simulates action on said simulated television receiver, changes scenes on said simulated television and changes channels and programs, so that a potential burglar will think someone is home watching said television receiver and will therefore prevent a break in by acting as a deterrent not an alarm and is in effect operative before a break in is tried said filaments are clear and said bulb is blue in color, said light source electrically connecting means includes a threaded socket in said housing which is electrically connected to said electrical circuit, so that said threaded base of said incandescent bulb can be screwed into said threaded socket in said housing, said light source is an incandescent bulb having threaded base and multiple filaments therein, a timer built into said housing and electrically connected to said electrical circuit between said switch, said flasher and said tape player, so that said time can operate said flasher and said tape player during predetermined time intervals, said light source varying brightness means is a flasher built into said housing, said sound simulating means includes a tape player built into said housing, a pre-recorded tape played within said tape player, a volume control on said housing electrically connected to said tape player, at least one speaker built into said housing electrically connected to said tape player, said on and off turning means is a switch, said picture simulating means includes a light source for producing a blue color therefrom, means for electrically connecting said light source to said electrical circuit in said housing, means electrically connected to said electrical circuit in said housing for varying the brightness of said light source;

d. means electrically connected to said electrical circuit in said housing for simulating the sound of the television receiver, whereby said on and off turning means will also turn said sound simulating means on and off; and e. means electrically connected between said electrical circuit in said housing and the power source for turning picture simulating means on and off.

7. A home security electronic device simulating a person at home watching a simulated television receiver, which comprises:

a) a housing having an electrical circuit therein;

b) means for electrically connecting said electrical circuit in said housing to a power source; and c) means electrically connected to said electrical circuit in said housing for projecting an illusion of a television receiver, said illusion is random, simulates action on said simulated television receiver, changes scenes on said simulated television and changes channels and programs, so that a potential burglar will think someone is home watching said television receiver and will therefore prevent a break in by acting as a deterrent not an alarm and is in effect operative before a break in is tried, said light source electrically connecting means includes a flourescent fixture built onto said housing which is electrically connected to said electrical circuit, so that said base ends of said flourescent bulbs can be connected into said flourescent fixture on said housing, said light source is a pair of blue colored florescent bulbs, each having base ends thereon, said filaments are clear and said bulb is blue in color, said light source electrically connecting means includes a threaded socket in said housing which is electrically connected to said electrical circuit, so that said threaded base of said incandescent bulb can be screwed into said threaded socket in said housing, said light source is an incandescent bulb having threaded base and multiple filaments therein, a timer built into said housing and electrically connected to said electrical circuit between said switch, said flasher and said tape player, so that said time can operate said flasher and said tape player during predetermined time intervals, said light source varying brightness means is a flasher built into said housing, said sound simulating means includes a tape player built into said housing, a pre-recorded tape played within said tape player, a volume control on said housing electrically connected to said tape player, at least one speaker built into said housing electrically connected to said tape player, said on and off turning means is a switch, said picture simulating means includes a light source for producing a blue color therefrom, means for electrically connecting said light source to said electrical circuit in said housing, means electrically connected to said electrical circuit in said housing for varying the brightness of said light source;

d. means electrically connected to said electrical circuit in said housing for simulating the sound of the television receiver, whereby said on and off turning means will also turn said sound simulating means on and off; and e. means electrically connected between said electrical circuit in said housing and the power source for turning picture simulating means on and off.

* * * * *